US007861802B2

(12) United States Patent
Underwood et al.

(10) Patent No.: US 7,861,802 B2
(45) Date of Patent: Jan. 4, 2011

(54) FLEXIBLE DIRECTIONAL DRILLING APPARATUS AND METHOD

(75) Inventors: Lance D. Underwood, Cypress, TX (US); Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 868 days.

(21) Appl. No.: 11/334,707

(22) Filed: Jan. 18, 2006

(65) Prior Publication Data

US 2007/0163810 A1 Jul. 19, 2007

(51) Int. Cl.
*E21B 7/04* (2006.01)
*E21B 10/26* (2006.01)

(52) U.S. Cl. ..... 175/76; 175/385; 175/406

(58) Field of Classification Search ..... None
See application file for complete search history.

(56) References Cited

U.S. PATENT DOCUMENTS 3,224,507 A 12/1965 Cordary et al.
3,425,500 A 2/1969 Fuchs
4,055,226 A 10/1977 Weber
4,467,879 A * 8/1984 Burge ..... 175/325.4
4,660,657 A 4/1987 Furse et al.
4,904,228 A * 2/1990 Frear et al. ..... 464/152
5,014,780 A 5/1991 Skipper
5,060,736 A 10/1991 Neff
5,113,953 A 5/1992 Noble
5,168,941 A 12/1992 Krueger et al.
5,305,838 A 4/1994 Pauc et al.
5,307,885 A 5/1994 Kuwana et al.
5,318,137 A 6/1994 Johnson et al.
5,318,138 A 6/1994 Dewey et al.
5,332,048 A 7/1994 Underwood et al.
5,368,114 A 11/1994 Tandberg et al.

(Continued)

FOREIGN PATENT DOCUMENTS

BE 1012545 A3 12/2000

(Continued)

OTHER PUBLICATIONS

Examination Report dated Jul. 9, 2008 issued by the U.K. Intellectual Property Office in corresponding Application No. GB0700994.7, 3 pages.

(Continued)

*Primary Examiner*—Zakiya W. Bates
(74) *Attorney, Agent, or Firm*—Osha Liang LLP

(57) ABSTRACT

A bottom hole assembly to directionally drill a subterranean formation includes a drill bit, a stabilizer assembly located proximate to and behind the drill bit, a drilling assembly comprising a drive mechanism and a directional mechanism, and a flex member. Optionally, the flex member may be located between the drilling assembly and the stabilizer assembly or an integral to a housing of the drilling assembly. A method to drill a formation includes positioning a stabilizer assembly behind a drill bit and positioning a flex member between an output shaft of a drilling assembly and the stabilizer assembly. The method preferably includes rotating the drill bit, stabilizer assembly, and flex member with a drilling assembly and directing the trajectory of the drill bit and stabilizer assembly with a directional mechanism of the drilling assembly.

15 Claims, 11 Drawing Sheets

U.S. PATENT DOCUMENTS

| | | | | |
|---|---|---|---|---|
| 5,484,029 | A | | 1/1996 | Eddison et al. |
| 5,520,255 | A | | 5/1996 | Barr et al. |
| 5,765,653 | A | | 6/1998 | Doster et al. |
| 5,857,531 | A | | 1/1999 | Estep et al. |
| 5,875,859 | A | | 3/1999 | Ikeda et al. |
| 5,971,085 | A | | 10/1999 | Colebrook |
| 6,039,131 | A | | 3/2000 | Beaton |
| 6,059,051 | A | * | 5/2000 | Jewkes et al. ..... 175/76 |
| 6,092,610 | A | | 7/2000 | Kosmala et al. |
| 6,109,372 | A | | 8/2000 | Dorel et al. |
| 6,213,226 | B1 | | 4/2001 | Eppink et al. |
| 6,227,312 | B1 | | 5/2001 | Eppink et al. |
| 6,269,893 | B1 | | 8/2001 | Beaton et al. |
| 6,289,999 | B1 | | 9/2001 | Dewey et al. |
| 6,360,831 | B1 | | 3/2002 | Akesson et al. |
| 6,378,632 | B1 | | 4/2002 | Dewey et al. |
| 6,470,977 | B1 | | 10/2002 | Chen et al. |
| 6,488,104 | B1 | | 12/2002 | Eppink et al. |
| 6,494,272 | B1 | | 12/2002 | Eppink et al. |
| 6,581,699 | B1 | | 6/2003 | Chen et al. |
| 6,668,949 | B1 | | 12/2003 | Rives |
| 6,732,817 | B2 | | 5/2004 | Dewey et al. |
| 6,769,499 | B2 | | 8/2004 | Cargill et al. |
| 6,848,518 | B2 | | 2/2005 | Chen et al. |
| 6,920,944 | B2 | | 7/2005 | Eppink et al. |
| 2003/0155155 | A1 | | 8/2003 | Dewey et al. |
| 2004/0134687 | A1 | | 7/2004 | Radford et al. |
| 2005/0145417 | A1 | | 7/2005 | Radford et al. |
| 2005/0211470 | A1 | | 9/2005 | Jeffryes |

FOREIGN PATENT DOCUMENTS

| | | | |
|---|---|---|---|
| EP | 0 301 890 | B1 | 6/1992 |
| EP | 0 594 420 | B1 | 12/1997 |
| GB | 2316427 | | 2/1998 |
| GB | 2319046 | | 5/1998 |
| GB | 2408526 | A | 6/2005 |
| WO | WO-00/31371 | A1 | 6/2000 |

OTHER PUBLICATIONS

Combined Search and Examination report dated Jan. 12, 2009 issued by the U.K. Intellectual Property Office in corresponding Application No. GB0822445.3, 6 pages.

Search and Examination Report for related United Kingdom Application No. GB0700994, dated Jun. 18, 2009 (3 pages).

Office Action for related Canadian Application No. 2,574,249, dated May 26, 2009 (2 pages).

Examiner's Report issued in corresponding Canadian Patent Application No. 2,574,249; Dated May 6, 2010 (2 pages).

* cited by examiner

FLEXIBLE DIRECTIONAL DRILLING APPARATUS AND METHOD

BACKGROUND OF INVENTION

Subterranean drilling operations are often performed to locate (exploration) or to retrieve (production) subterranean hydrocarbon deposits. Most of these operations include an offshore or land-based drilling rig to drive a plurality of interconnected drill pipes known as a drillstring. Large motors at the surface of the drilling rig apply torque and rotation to the drillstring, and the weight of the drillstring components provides downward axial force. At the distal end of the drillstring, a collection of drilling equipment known to one of ordinary skill in the art as a bottom hole assembly ("BHA"), is mounted. Typically, the BHA may include one or more of a drill bit, a drill collar, a stabilizer, a reamer, a mud motor, a rotary steering tool, measurement-while-drilling sensors, and any other device useful in subterranean drilling.

While most drilling operations begin as vertical drilling operations, often the borehole drilled does not maintain a vertical trajectory along its entire depth. Often, changes in the subterranean formation will dictate changes in trajectory, as the drillstring has natural tendency to follow the path of least resistance. For example, if a pocket of softer, easier to drill, formation is encountered, the BHA and attached drillstring will naturally deflect and proceed into that softer formation rather than a harder formation. While relatively inflexible at short lengths, drillstring and BHA components become somewhat flexible over longer lengths. As borehole trajectory deviation is typically reported as the amount of change in angle (i.e. the "build angle") over one hundred feet, borehole deviation can be imperceptible to the naked eye. However, over distances of over several thousand feet, borehole deviation can be significant.

Many borehole trajectories today desirably include planned borehole deviations. For example, in formations where the production zone includes a horizontal seam, drilling a single deviated bore horizontally through that seam may offer more effective production than several vertical bores. Furthermore, in some circumstances, it is preferable to drill a single vertical main bore and have several horizontal bores branch off therefrom to fully reach and develop all the hydrocarbon deposits of the formation. Therefore, considerable time and resources have been dedicated to develop and optimize directional drilling capabilities.

Typical directional drilling schemes include various mechanisms and apparatuses in the BHA to selectively divert the drillstring from its original trajectory. An early development in the field of directional drilling included the addition of a positive displacement mud motor in combination with a bent housing device to the bottom hole assembly. In standard drilling practice, the drillstring is rotated from the surface to apply torque to the drill bit below. With a mud motor attached to the bottom hole assembly, torque can be applied to the drill bit therefrom, thereby eliminating the need to rotate the drillstring from the surface. Particularly, a positive displacement mud motor is an apparatus to convert the energy of high-pressure drilling fluid into rotational mechanical energy at the drill bit. Alternatively, a turbine-type mud motor may be used to convert energy of the high-pressure drilling fluid into rotational mechanical energy. In most drilling operations, fluids known as "drilling muds" or "drilling fluids" are pumped down to the drill bit through a bore of the drillstring where the fluids are used to clean, lubricate, and cool the cutting surfaces of the drill bit. After exiting the drill bit, the used drilling fluids return to the surface (carrying suspended formation cuttings) along the annulus formed between the cut borehole and the outer profile of the drillstring. A positive displacement mud motor typically uses a helical stator attached to a distal end of the drillstring with a corresponding helical rotor engaged therein and connected through the mud motor driveshaft to the remainder of the BHA therebelow. As such, pressurized drilling fluids flowing through the bore of the drillstring engage the stator and rotor, thus creating a resultant torque on the rotor which is, in turn, transmitted to the drill bit below.

Therefore, when a mud motor is used, it is not necessary to rotate the drillstring to drill the borehole. Instead, the drillstring slides deeper into the wellbore as the bit penetrates the formation. To enable directional drilling with a mud motor, a bent housing is added to the BHA. A bent housing appears to be an ordinary section of the BHA, with the exception that a low angle bend is incorporated therein. As such, the bent housing may be a separate component attached above the mud motor (i.e. a bent sub), or may be a portion of the motor housing itself. Using various measurement devices in the BHA, a drilling operator at the surface is able to determine which direction the bend in the bent housing is oriented. The drilling operator then rotates the drillstring until the bend is in the direction of a desired deviated trajectory and the drillstring rotation is stopped. The drilling operator then activates the mud motor and the deviated borehole is drilled, with the drillstring advancing without rotation into the borehole (i.e. sliding) behind the BHA, using only the mud motor to drive the drill bit. When the desired direction change is complete, the drilling operator rotates the entire drillstring continuously so that the directional tendencies of the bent housing are eliminated so that the drill bit may drill a substantially straight trajectory. When a change of trajectory is again desired, the continuous drillstring rotation is stopped, the BHA is again oriented in the desired direction, and drilling is resumed by sliding the BHA.

One drawback of directional drilling with a mud motor and a bent housing is that the bend may create high lateral loads on the bit, particularly when the system is either kicking off (that is, initiating a directional change) from straight hole, or when it is being rotated in straight hole. The high lateral loads can cause excessive bit wear and a rough wellbore wall surface.

Another drawback of directional drilling with a mud motor and a bent housing arises when the drillstring rotation is stopped and forward progress of the BHA continues with the positive displacement mud motor. During these periods, the drillstring slides further into the borehole as it is drilled and does not enjoy the benefit of rotation to prevent it from sticking in the formation. Particularly, such operations carry an increased risk that the drillstring will become stuck in the borehole and will require a costly fishing operation to retrieve the drillstring and BHA. Once the drillstring and BHA is fished out, the apparatus is again run into the borehole where sticking may again become a problem if the borehole is to be deviated again and the drillstring rotation stopped. Furthermore, another drawback to drilling without rotation is that the effective coefficient of friction is higher, making it more difficult to advance the drillstring into the wellbore. This results in a lower rate of penetration than when rotating, and can reduce the overall "reach", or extent to which the wellbore can be drilled horizontally from the drill rig.

In recent years, in an effort to combat issues associated with drilling without rotation, rotary steerable systems ("RSS") have been developed. In a rotary steerable system, the BHA trajectory is deflected while the drillstring continues to rotate. As such, rotary steerable systems are generally divided into two types, push-the-bit systems and point-the-bit systems. In a push-the-bit RSS, a group of expandable thrust pads extend laterally from the BHA to thrust and bias the drillstring into a desired trajectory. An example of one such system is described in U.S. Pat. No. 5,168,941. In order for this to occur while the drillstring is rotated, the expandable thrusters extend from what is known as a geostationary portion of the drilling assembly. Geostationary components do not rotate relative to the formation while the remainder of the drillstring is rotated. While the geostationary portion remains in a substantially consistent orientation, the operator at the surface may direct the remainder of the BHA into a desired trajectory relative to the position of the geostationary portion with the expandable thrusters. An alternative push-the-bit rotary steering system is described in U.S. Pat. No. 5,520,255, in which lateral thrust pads are mounted on a body which is connected to and rotates at the same speed as that of the rest of the BHA and drill string. The pads are cyclically driven, controlled by a control module with a geostationary reference, to produce a net lateral thrust which is substantially in the desired direction.

In contrast, a point-the-bit RSS includes an articulated orientation unit within the assembly to "point" the remainder of the BHA into a desired trajectory. Examples of such a system are described in U.S. Pat. Nos. 6,092,610 and 5,875,859. As with a push-the-bit RSS, the orientation unit of the point-the-bit system is either located on a geostationary collar or has either a mechanical or electronic geostationary reference plane, so that the drilling operator knows which direction the BHA trajectory will follow. Instead of a group of laterally extendable thrusters, a point-the-bit RSS typically includes hydraulic or mechanical actuators to direct the articulated orientation unit into the desired trajectory. While a variety of deflection mechanisms exist, what is common to all point-the-bit systems is that they create a deflection angle between the lower, or output, end of the system with respect to the axis of the rest of the BHA. While point-the-bit and push-the-bit systems are described in reference to their ability to deflect the BHA without stopping the rotation of the drillstring, it should be understood that they may nonetheless include positive displacement mud motors to enhance the rotational speed applied to the drill bit.

Many systems have been proposed in the prior art to improve the directional abilities of bent-housing directional drilling assemblies. U.S. Pat. No. 5,857,531 ("the '531 patent"), incorporated herein by reference, discloses one such system whereby a BHA includes a flexible section located between the bend in a bent housing and a power generation housing of a mud motor. The flexible section allows the BHA to be configured to achieve elevated build rates without generating excess loads and stresses on BHA components. Nonetheless, embodiments of the present invention offer improvements over the known prior art in the field of directional drilling.

Underreaming while drilling has become an accepted practice because it allows use of smaller casing strings and less cement. U.S. Pat. No. 6,732,817 represents a widely used underreaming tool. Historically, when underreaming in a directionally drilled well, the bottom hole assembly included a pilot bit, a directional control system, a directional measurement system, and an underreamer, in that order. Typically, the underreamer opens the well bore up to a diameter that is generally 15% to 20% larger than the diameter of the pilot bit. Since the combined length of the directional control and measurement systems is approximately one hundred feet long, the underreamer is located slightly greater than that distance from the bit. As a result, when drilling ceases and the drill string is withdrawn from the well bore, the bottom one hundred foot portion of the well bore is the diameter of the pilot bit, as opposed to the full diameter of the underreamer. The undersized pilot hole is undesirable in the sense that if casing is to be set in the wellbore following the use of such a BHA, the casing must be set at least one hundred feet off bottom. The remaining uncased hole can be a source of unwanted influx of reservoir fluids or high pressure gas. It is therefore advantageous for the underreamer to be located as close as possible to the bit. However, the high side loads caused by bent-sub directional BHA's could prevent underreamers from opening, or could overload the mechanisms which cause them to expand. It is therefore desirable to design a system which reduces such side loads.

SUMMARY OF INVENTION

According to one aspect of the invention, a bottom hole assembly to directionally drill a subterranean formation includes a drill bit and a stabilizer assembly located proximate to and behind the drill bit. Furthermore, the bottom hole assembly preferably includes a drilling assembly comprising a drive mechanism and a directional mechanism, wherein an output shaft of the drive mechanism is located below the directional mechanism. Furthermore, the bottom hole assembly preferably includes a flex housing integral with the drilling assembly.

According to one aspect of the invention, a bottom hole assembly to directionally drill a subterranean formation includes a drill bit and a stabilizer assembly located proximate to and behind the drill bit. Furthermore, the bottom hole assembly preferably includes a drilling assembly comprising a drive mechanism and a directional mechanism, wherein an output shaft of the drive mechanism is located below the directional mechanism. Furthermore, the bottom hole assembly preferably includes a flex member located between the drilling assembly and the stabilizer assembly.

According to another aspect of the invention, a method to directionally drill a subterranean formation includes positioning a stabilizer assembly behind a drill bit and positioning a flex member between an output shaft of a drilling assembly and the stabilizer assembly, wherein the output shaft of the drilling assembly is located below a directional mechanism of the drilling apparatus. Furthermore, the method preferably includes rotating the drill bit, stabilizer assembly, and flex member with the drilling assembly to penetrate the formation and directing a trajectory of the drill bit and stabilizer assembly with the directional mechanism.

According to another aspect of the invention, a flex member located between a directional drilling assembly and a stabilized drill bit includes a reduced moment of inertia portion extending between the stabilized drill bit and an output shaft of the directional drilling assembly. Furthermore, the flex member preferably includes a diametric transition region located between the reduced moment of inertia portion and the stabilized drill bit, wherein the reduced moment of inertia portion is configured to be locally flexible along a length thereof relative to components of the directional drilling assembly.

According to another aspect of the invention, a method of drilling a borehole includes disposing a drill bit and a stabilizer assembly at a distal end of a drillstring, disposing a flex member between a drilling assembly and the stabilizer assembly, drilling the borehole with the drill bit and the drilling assembly, and stabilizing the drill bit with stabilizer pads of the stabilizer assembly.

According to another aspect of the present invention, a method to directionally drill a subterranean formation includes positioning a stabilizer assembly behind a drill bit, positioning a flex member in a housing of a drilling assembly, rotating the drill bit and stabilizer assembly with the drilling assembly to penetrate the formation, and directing a trajectory of the drill bit, and stabilizer assembly with a directional mechanism of the drilling assembly.

According to another aspect of the present invention, a bottom hole assembly to directionally drill a subterranean formation includes a drill bit, a stabilizer assembly located proximate to and behind the drill bit, a drilling assembly comprising a drive mechanism and a directional mechanism, and a flex member located within a housing of the drilling assembly.

According to another aspect of the present invention, a method to design a bottom hole assembly includes positioning a flex member between a directional mechanism of a drilling assembly and a drill bit, selecting the flex member such that an EI value is between a calculated minimum and a calculated maximum.

DETAILED DESCRIPTION

Embodiments of the invention relate generally to a drilling assembly to be used in subterranean drilling. More particularly, certain embodiments relate to a bottom hole assembly incorporating a flex member located between a drill bit and a drilling assembly. In some embodiments, the drilling assembly includes a rotary steerable assembly and in other embodiments, the drilling assembly includes a downhole mud motor. Furthermore, in certain embodiments an output shaft of the drilling assembly is positioned below a directional mechanism of the drilling assembly, and in other embodiments, the output shaft of the drilling assembly is located above the directional mechanism. Additionally, in some embodiments, the flex member is integrated into the drilling assembly as a portion of the housing thereof.

Figure 1:
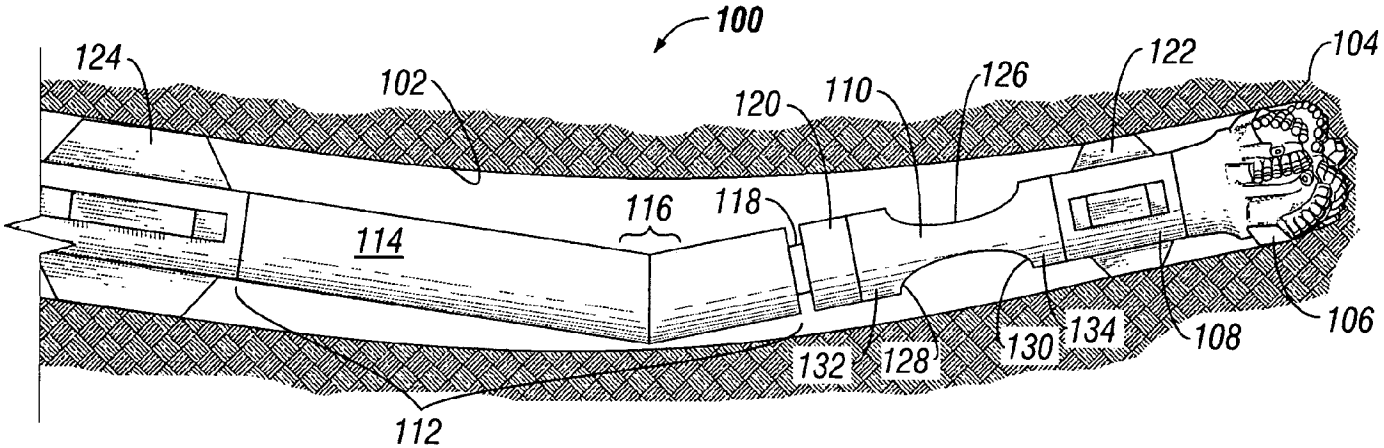
FIG. 1 is a schematic view drawing of a bottom hole assembly in accordance with a first exemplary embodiment of the present invention.

Referring now to FIG. 1, a bottom hole assembly 100 in accordance with a first embodiment of the present invention is schematically shown drilling a borehole 102 in a subterranean formation 104. Bottom hole assembly 100 includes a drill bit 106, a stabilizer assembly 108, a flex member 110, and a drilling assembly 112. Drilling assembly 112, preferably includes a drive mechanism 114 and a directional mechanism 116. In the embodiment shown in FIG. 1, drive mechanism 114 includes a positive displacement mud motor and directional mechanism 116 includes a bent housing assembly integral to the mud motor. As such, an output shaft 118 of positive displacement mud motor 114 extends below bent housing 116 and provides a rotary threaded connection 120 to lower components of BHA 100. Output shaft 118 is powered by the positive displacement mud motor, and therefore rotates relative to the external housing of drive mechanism 114. While drill bit 106 is shown schematically as a polycrystalline diamond compact drill bit, it should be understood that any drill bit known to one of ordinary skill in the art, including, but not limited to impregnated diamond and rotary cone bits, may be used. Furthermore, stabilizer assembly 108 may be a fixed-pad or adjustable gauge stabilizer assembly, wherein adjustable gauge stabilizer include arms 122 capable of being selectively expanded or retracted to allow drilling assembly 100 to pass through reduced diameter portions (e.g. casing strings) of borehole 102. Optionally, bottom hole assembly 100 of FIG. 1 may include a second stabilizer assembly 124 located above drilling assembly 112. Second stabilizer assembly 124 acts together with stabilizer assembly 108 to control the directional tendency of the BHA when the drill string is being rotated.

Referring still to FIG. 1, flex member 110 as shown, is constructed as a flex joint and includes a reduced outer diameter portion 126 and a pair of diametric transition regions 128, 130 located between outer diameter portion 126 and respective full diameter ends 132, 134 thereof. Reduced outer diameter portion 126 enables flex member 110 to have a reduced cross-sectional moment of inertia, I, such that outer diameter portion 126 is locally flexible relative to other BHA 100 components when manufactured of the same material (e.g. steel). Additionally, increased flexibility of flex member 110 may be accomplished through the use of a material having a modulus of elasticity (i.e. Young's Modulus, E) lower than that of other BHA 100 components, including, but not limited to, copper-beryllium and titanium. Steel has a Young's Modulus of about 28,000,000 to 30,000,000, whereas commercially available alloys of copper-beryllium and copper-nickel have a Young's Modulus of about 18,000,000 to 19,000,000 psi and titanium alloys have a Young's modulus of 15,000,000 to 16,500,000 psi. While various alternative materials having varied moduli may be used, materials exhibiting elevated fatigue strength and fracture toughness properties are preferred.

Additionally, the flexibility in flex member 110 may be varied by using reduced outer diameter portions 126 of differing lengths. Modeling analysis indicates that in a BHA 100 employing a 3-foot flex member 110 having a 5.0" reduced outer diameter portion 126 and a 2.75" inner diameter, the magnitude of side loads experienced by mud motor 114 may be reduced by as much as 77% when drilling at a 5°/100 ft build rate when compared to a mud motor 114 having no flex member 110. Comparably, a 2-foot flex member 110 may reduce side loads by as much as 50% in similar drilling conditions. Therefore, the presence of flex member 110 in bottom hole assembly 100 not only enables increased build rates in drill bit 106, but also may significantly reduce the amount of side loads experienced by mud motor 114 in the range of formerly possible build rates. Therefore, by reducing the magnitude of side loads experienced by mud motor 114, BHA 100 of FIG. 1 prolongs the life of mud motor 114 and lengthens the maintenance interval thereof.

Furthermore, while flex member 110 is shown as a generally tubular component having a constant reduced outer diameter portion 126, it should be understood by one of ordinary skill in the art that various other geometries may be used. Particularly, any cross-sectional geometry having a favorable moment of inertia I may be used in flex member 110, including, but not limited to circular, polygonal, elliptical, and any combination thereof. Additionally, it should be understood that the cross sectional moment of inertial, I, may be variable along the length of flex member 110. In such circumstances where I varies along the length of flex member 110, it should be understood by one of ordinary skill in the art that I may be represented as an average value for the purpose of calculating and predicting flex in the BHA 100.

Figure 2:
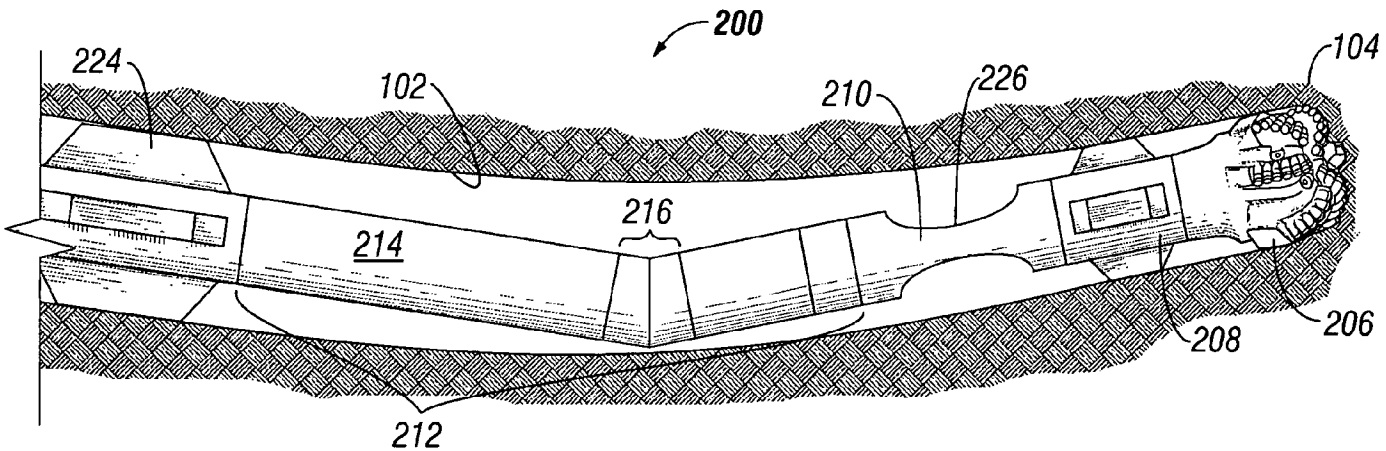
FIG. 2 is a schematic view drawing of a bottom hole assembly in accordance with a second exemplary embodiment of the present invention.

Referring now to FIG. 2, a bottom hole assembly 200 in accordance with a second embodiment of the present invention is schematically shown drilling a borehole 102 in a subterranean formation 104. Bottom hole assembly 200 includes a drill bit 206, a stabilizer assembly 208, a flex member 210, and a drilling assembly 212. Drilling assembly 212, preferably includes a drive mechanism 214 and a directional mechanism 216. In the embodiment shown in FIG. 2, drive mechanism 214 is a drillstring rotated from the surface and directional mechanism 216 includes an articulated joint of a point-the-bit rotary steerable system. The output housing or shaft of the directional mechanism rotates at the same speed as that of the drive mechanism. As such, flex member 210, similarly to flex member 110 of FIG. 1, includes a reduced outer diameter portion 226 that reduces the magnitude of side loads and stresses experienced by articulated RSS joint 216. In bottom hole assembly 200, drive mechanism 214 may be a turbine or mud motor, or may be the drillstring itself, as rotary steerable systems may direct drill bit 206 under drillstring rotation. However, unlike the bent housing 116 configuration of FIG. 1, the directional mechanism 216 of FIG. 2 is a relatively delicate part that should be shielded from excess loading wherever possible. Therefore, in using flex member 210 with a point-the-bit RSS, greatly reduced loads are transmitted to articulated joint 216, thus improving the life and maintenance intervals thereof.

Figure 3:
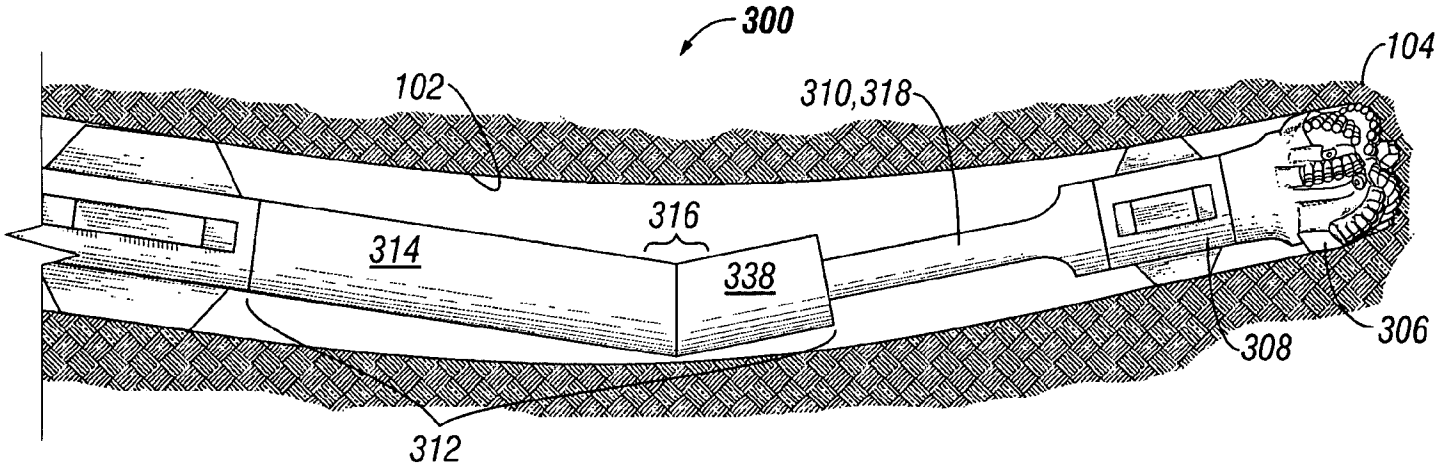
FIG. 3 is a schematic view drawing of a bottom hole assembly in accordance with a third exemplary embodiment of the present invention.

Referring now to FIG. 3, a bottom hole assembly 300 in accordance with a third embodiment of the present invention is schematically shown drilling a borehole 102 in a subterranean formation 104. Bottom hole assembly 300 includes a drill bit 306, a stabilizer assembly 308, a flex member 310, and a drilling assembly 312. Drilling assembly 312, preferably includes a drive mechanism 314 and a directional mechanism 316. In the embodiment shown in FIG. 3, drive mechanism 314 includes a positive displacement mud motor and directional mechanism 316 includes a bent housing. Bottom hole assembly 300 of FIG. 3 differs from bottom hole assembly 100 of FIG. 1 in that flex member 310 is integrated into what would have been an output shaft (e.g. 118 of FIG. 1) of positive displacement mud motor 314. While flex member 110 of FIG. 1 is capable of being retrofitted to any drilling assembly, flex member 310 is specifically designed, tailored, and optimized for a particular drilling assembly 312. Therefore, drilling assembly 312 will include an output shaft 318 that substantially seamlessly transforms into a flex member 310 as it exits a lower housing 338 below bent housing 316.

Figure 4:
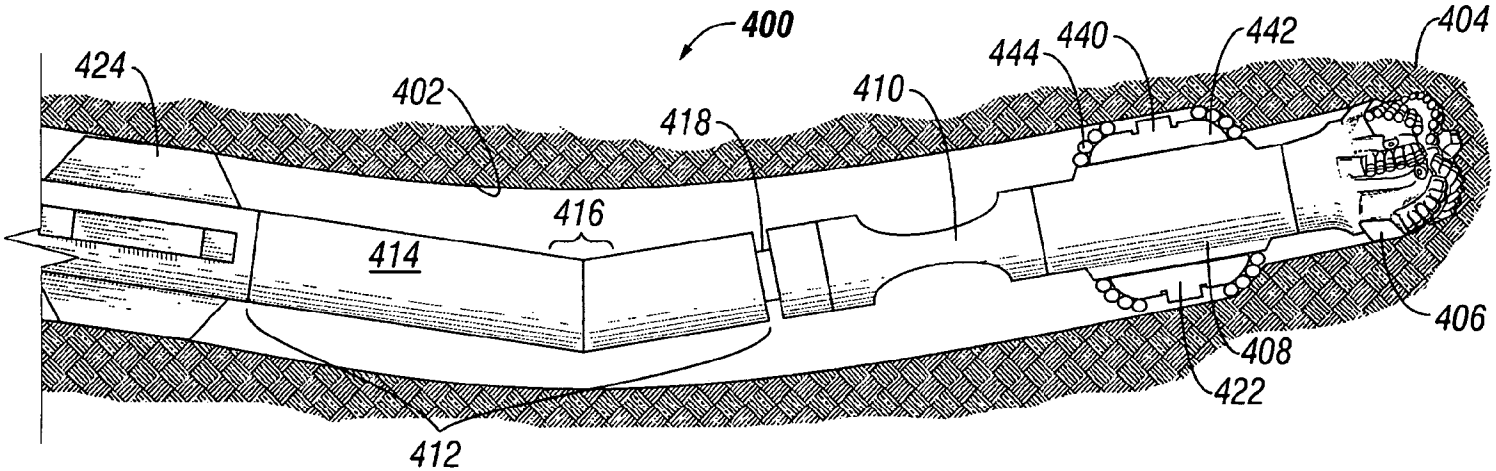
FIG. 4 is a schematic view drawing of a bottom hole assembly in accordance with a fourth exemplary embodiment of the present invention.

Referring now to FIG. 4, a bottom hole assembly 400 in accordance with a fourth embodiment of the present invention is schematically shown drilling an underreamed borehole 402 in a subterranean formation 404. Bottom hole assembly 400 includes a drill bit 406, a stabilizer assembly 408, a flex member 410, and a drilling assembly 412. Drilling assembly 412, preferably includes a drive mechanism 414 and a directional mechanism 416. In the embodiment shown in FIG. 4, drive mechanism 414 includes a positive displacement mud motor and directional mechanism 416 includes a bent housing. Bottom hole assembly 400 of FIG. 4 differs from bottom hole assembly 100 of FIG. 1 in that stabilizer assembly 408 is a stabilized underreamer that includes stabilizer pads 440 and reamer cutters 442, 444 upon arms 422. As mentioned above, arms 422 may be optionally retractable into and extendable from stabilizer assembly 408 so that bottom hole assembly 400 may pass through reduced diameter portions of borehole 402. Particularly, cutters 442 are underreamer cutters, designed to enlarge borehole 402 while BHA 400 is engaged further into formation 404, and cutters 444 are backreamer cutters, designed to enlarge borehole 402 as BHA 400 is pulled out of formation 404.

As shown in FIG. 4, underreamer cutters 442 simultaneously enlarge borehole 402 to full gauge while drill bit 406 cuts a pilot bore. Stabilizer pads 440 of arms 422 act to brace stabilizer assembly 408 and drill bit 406 while bore 402 is being cut. As such, drilling assembly 412, positioned between stabilizers 424 and 408 acts through flex member 410 to bias drill bit 406 into a desired build angle without over stressing output shaft 418 of mud motor 414. The flex member further serves to absorb bending moment, thereby preventing excessive side loads that would prevent the stabilized underreamer from functioning. Alternatively, stabilizer assembly 408 and drill bit 406 may be constructed as a single integrated device, such that the axial distance between stabilizer assembly 408 and drill bit 406 are minimized. Such an apparatus is described by U.S. patent application Ser. No. 11/334,195 entitled "Drilling and Hole Enlargement Device" filed on Jan. 18, 2006 by inventors John Campbell, Charles Dewey, Lance Underwood, and Ronald Schmidt, hereby incorporated by reference in its entirety. In the aforementioned Application, a stabilizer assembly is located behind the drill bit by a distance of between one to five times a cutting diameter of the drill bit.

Figure 5:
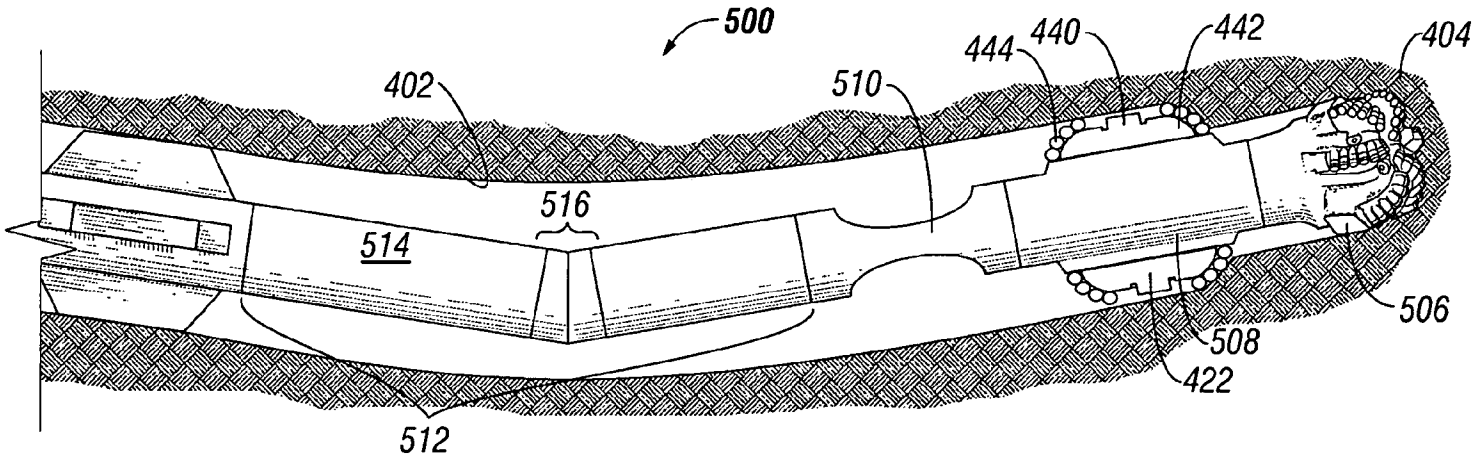
FIG. 5 is a schematic view drawing of a bottom hole assembly in accordance with a fifth exemplary embodiment of the present invention.

Referring briefly to FIG. 5, a bottom hole assembly 500 in accordance with a fifth embodiment of the present invention is schematically shown drilling a borehole 402 in a subterranean formation 404. Bottom hole assembly 500 includes a drill bit 506, a stabilizer assembly 508, a flex member 510, and a drilling assembly 512. Drilling assembly 512 preferably includes a drive mechanism 514 and a directional mechanism 516. Drive mechanism 514 is a drillstring rotated from the surface, and directional mechanism 516 includes an articulated joint of a point-the-bit rotary steerable system. As such, drilling assembly 500 is similar to drilling assembly 200 of FIG. 2 with the exception that stabilizer assembly 508 is a stabilized underreamer that includes stabilizer pads 440 and reamer cutters 442, 444 upon selectively retractable and extendable arms 422. Similar to stabilizer assembly 408 of FIG. 4 discussed above, stabilizer assembly 508 may allow arms 422 to be selectively retracted and extended with cutters 442, 444 to ream borehole 402 while drilling.

Figure 6:
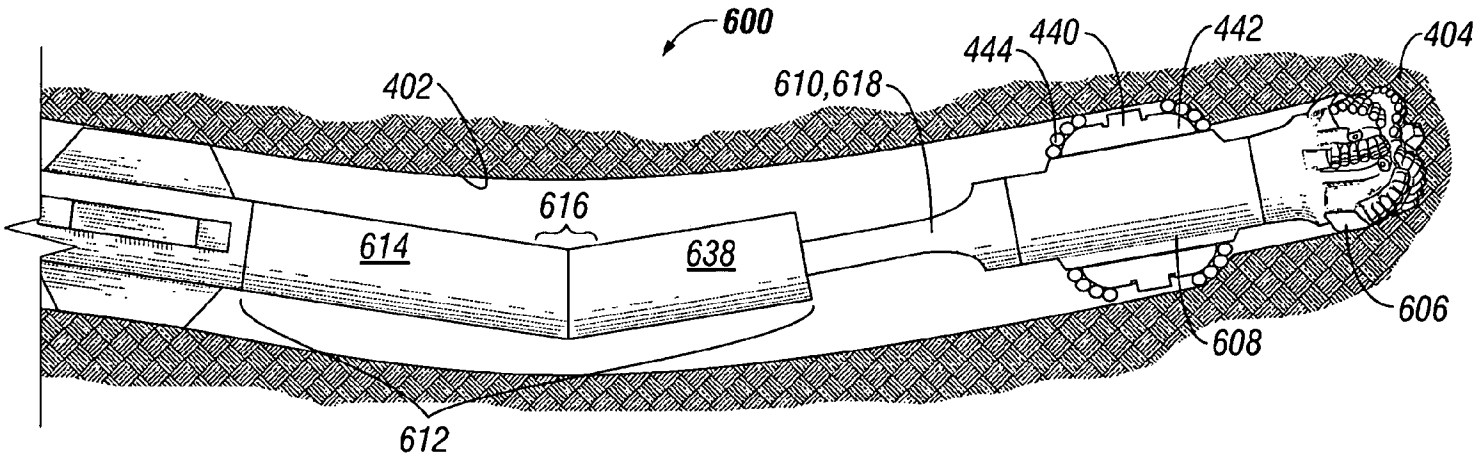
FIG. 6 is a schematic view drawing of a bottom hole assembly in accordance with a sixth exemplary embodiment of the present invention.

Similarly, referring briefly now to FIG. 6, a bottom hole assembly 600 in accordance with a sixth embodiment of the present invention is schematically shown drilling a borehole 402 in a subterranean formation 404. Bottom hole assembly 600 includes a drill bit 606, a stabilizer assembly 608, a flex member 610, and a drilling assembly 612. Drilling assembly 612, preferably includes a drive mechanism 614 and a directional mechanism 616. In the embodiment shown in FIG. 6, drive mechanism 614 includes a positive displacement mud motor and directional mechanism 616 includes a bent housing. Bottom hole assembly 600 of FIG. 6 differs from bottom hole assembly 400 of FIG. 4 in that flex member 610 is integrated into what would have been an output shaft (e.g. 418 of FIG. 4) of positive displacement mud motor 614. While flex member 410 of FIG. 4 is capable of being retrofitted to any drilling assembly, flex member 610 is specifically designed, tailored, and optimized for a particular drilling assembly 612. Therefore, drilling assembly 612 will include an output shaft 618 that substantially seamlessly transforms into a flex member 610 as it exits a lower housing 638 below bent housing 616. As such, drilling assembly 600 is similar to drilling assembly 300 of FIG. 3, with the exception that stabilizer assembly 608 is a stabilized underreamer that includes stabilizer pads 440 and reamer cutters 442, 444 upon optionally retractable and extendable arms 422. Similar to stabilizer assembly 408 of FIG. 4 discussed above, stabilizer assembly 608 may allow arms 422 to be selectively retracted and extended with cutters 442, 444 to ream borehole 402 while drilling.

Figure 7:
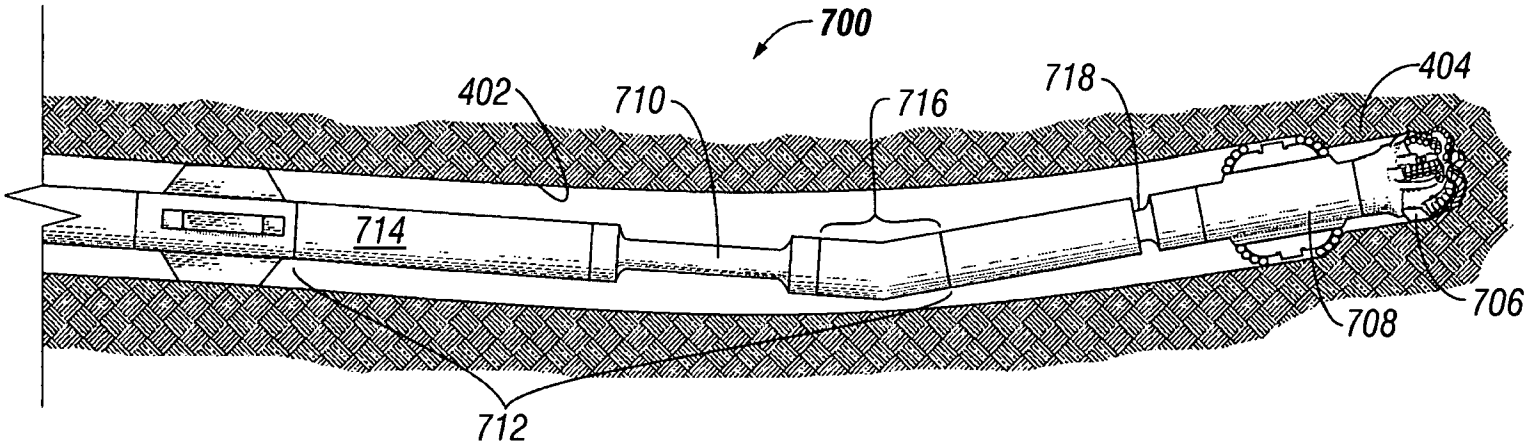
FIG. 7 is a schematic view drawing of a bottom hole assembly in accordance with a seventh exemplary embodiment of the present invention.

Referring now to FIG. 7, a bottom hole assembly 700 in accordance with a seventh embodiment of the present invention is schematically shown drilling a borehole 402 in a subterranean formation 404. Bottom hole assembly 700 includes a drill bit 706, a stabilizer assembly (preferably a stabilized underreamer, as shown) 708, and a drilling assembly 712. Drilling assembly 712, preferably includes a drive mechanism 714 and a directional mechanism 716. In the embodiment shown in FIG. 7, drive mechanism 714 includes a positive displacement mud motor and directional mechanism 716 includes a bent housing. Bottom hole assembly 700 of FIG. 7 differs from bottom hole assembly 400 of FIG. 4 in that a flex member 710 is integrated into a housing of drilling assembly 712. In the case of a positive displacement mud motor, the preferred location for the flexible housing is between the stator of the mud motor and the bend. Flexible section 710 may be integrated into the bent housing 716 itself. As such, while drilling a deviated portion of wellbore 402, flex member 710 incorporated into housing of drilling assembly 712 absorbs bending moment and thereby relieves the stabilized underreamer 708 and motor output shaft 718 of excessive side loads and bending stress. As such, an output shaft (not shown) extends from drive mechanism 714 through flex member 710 and bent housing directional mechanism 716 en route to the remainder (i.e. stabilizer assembly 708 and drill bit 706) of bottom hole assembly 700.

Figure 8:
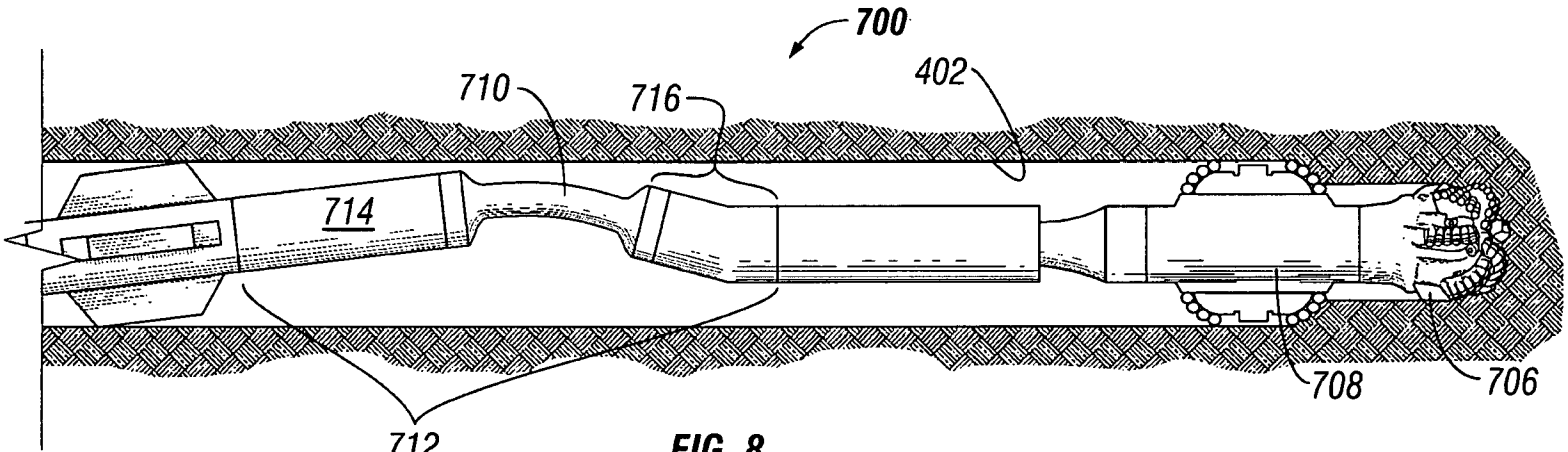
FIG. 8 is a schematic view drawing of the bottom hole assembly of FIG. 7 in a straight hole.

Referring briefly to FIG. 8, bottom hole assembly 700 of FIG. 7 is shown schematically drilling borehole 402 in a straight hole condition. Particularly, in straight hole, the entire drillstring is rotated from the surface to drive drill bit 706 and stabilizer assembly 708. As such, flex housing 710 of drilling assembly 712 is shown absorbing bending moments and side loads created by surface rotation of BHA 700 with bent housing directional mechanism 716 in a straight hole. It should be understood that the bending of flex member 710 is severely exaggerated in FIG. 8 for illustrative purposes and that the amount of bend experienced by flex member 710 in drilling assembly 712 will be much less. Nonetheless, FIG. 8 depicts flex member 710 absorbing bending moments generated when a bent housing directional mechanism 716 is run in a straight hole. It should be understood that FIGS. 1, 3, 4, and 6, while not showing their respective bottom hole assemblies (100, 300, 400, and 600) in straight hole situations, would exhibit similar bending moment absorption in their respective flex members 110, 310, 410, and 610.

Figure 9:
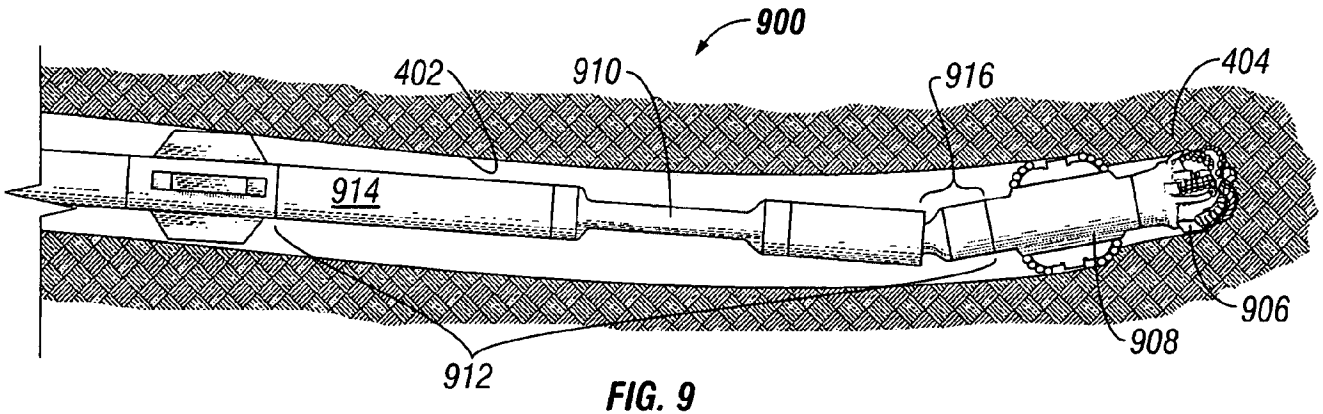
FIG. 9 is a schematic view drawing of a bottom hole assembly in accordance with an eighth exemplary embodiment of the present invention.

Referring now to FIG. 9, a bottom hole assembly 900 in accordance with a eighth embodiment of the present invention is schematically shown drilling a borehole 402 in a subterranean formation 404. Bottom hole assembly 900 includes a drill bit 906, a stabilizer assembly (shown as a stabilized underreamer) 908, and a drilling assembly 912. Drilling assembly 912, preferably includes a drive mechanism 914 and a directional mechanism 916. In the embodiment shown in FIG. 9, drive mechanism 914 is depicted as a drill string and directional mechanism 916 includes a point-the-bit rotary steerable system. While drive mechanism 914 is depicted as a distal end of a drillstring rotated from the surface, it should be understood that a positive displacement mud motor may be used as well. Similarly to BHA 700 of FIG. 7 discussed above, BHA 900 of FIG. 9 differs from bottom hole assemblies discussed above in that a flex member 910 is integrated into a housing of drilling assembly 912. As such, while drilling a deviated portion of wellbore 402, flex member 910 incorporated into housing of drilling assembly may 912 absorb bending stresses rather than have those bending stresses negatively affect other BHA 900 components.

Referring now to FIG. 10-16, graphical representations for various characteristics for bottom hole assemblies incorporating some aspects of the present invention are shown. While the representations of FIGS. 10-16 depict the results for various data inputs, they should not be considered limiting on the scope and breadth of the claims appended below.

Figure 10:
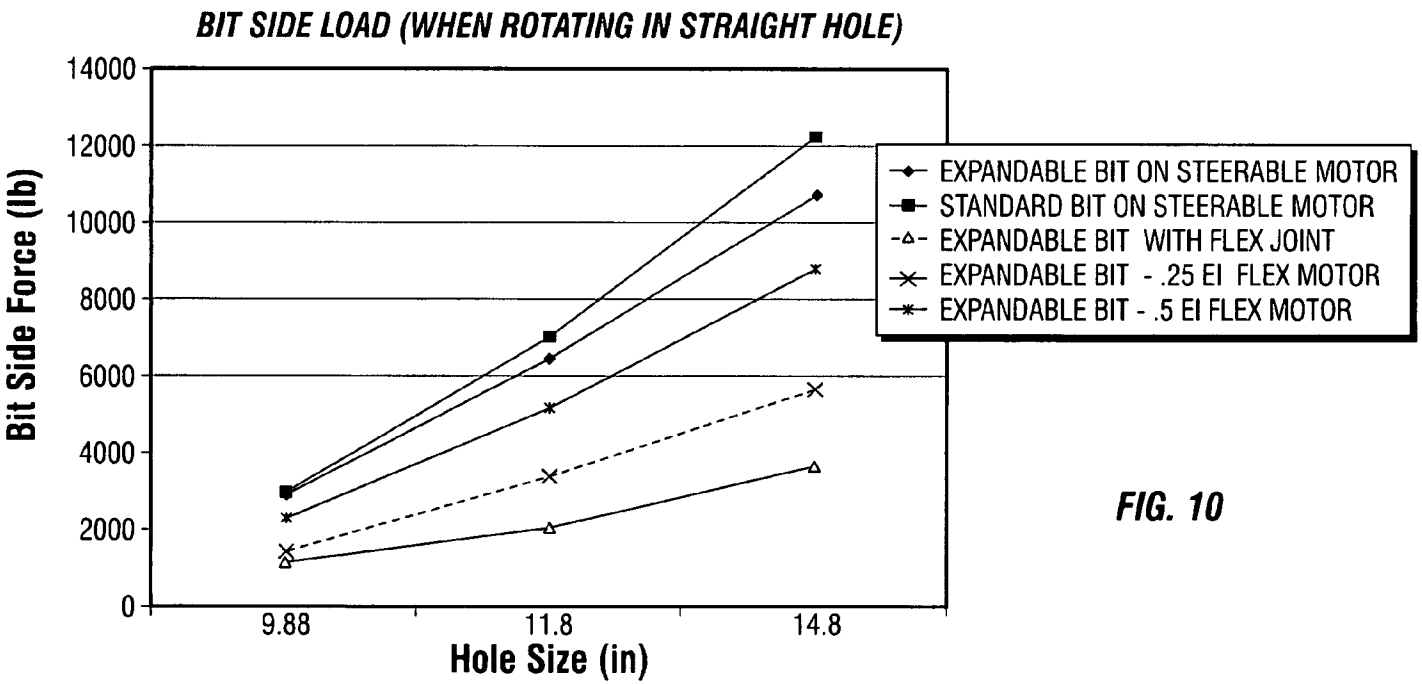
FIG. 10 is a graphical representation of bit force as a function of hole size for various bottom hole assemblies in accordance with embodiments of the present invention.

Referring to FIG. 10, a graphical representation for bit load in various bottom hole assemblies is depicted. FIG. 10 graphically represents the bit load as a function of hole size for five different bottom hole assemblies at the same build rate. Referring to the graph, a standard bit on a steerable motor represents the highest amount of bit load for any given hole size. An expandable bit (i.e. a pilot bit in conjunction with an expandable reamer or stabilized underreamer) run on a steerable motor represents the next highest amount of bit load. Next, an expandable bit having a flex member located between the expandable bit and the mud motor (e.g. as depicted in FIG. 4) represents the lowest amount of side force for each hole size. Finally, two examples of expandable bits with integral motor housing flex members (e.g. as depicted in FIG. 7) represent bit load values between that of the expandable bit with or without the flex member between the motor and the bit. The data on this graph is generated by modeling bent-housing mud motors, but a bent RSS with similar geometry would yield similar values.

The two integral housing assemblies differ in either their values for E, modulus of elasticity, their values for I, the cross-sectional moment of inertia for the flex housing section, or both. Because both properties, E and I, affect the flexibility of flex housing, their product is used to indicate the overall flexibility created by the geometric and material properties combined. As such, the lower the value of EI, the more flexible the flex member. Furthermore, for the purpose of simplicity, the product EI for flex housing is depicted as a percentage of the EI value for a non-flex portion of the drilling assembly. Therefore, the 0.25 EI line of FIG. 10 represents a flex member portion of housing that four times as flexible (or, ¼ as stiff) as the remainder of the drilling assembly. Similarly, the 0.50 EI line of FIG. 10 represents a flex member portion of housing that is twice as flexible (or, ½ as stiff) as the remainder of the drilling assembly.

In the context of FIG. 10, bit load refers to the side load on a bit when run in conjunction with a drilling assembly (e.g. positive displacement mud motor or RSS), when rotated in a straight hole. In contrast, when the bottom hole assembly is sliding (e.g. when a positive displacement mud motor is run with a bent housing), the side force acts in one direction, and the bit side cuts in that direction until there is eventually no more side load. Furthermore, "Bit" in the context of FIG. 10 may refer to either a conventional bit, or a pilot bit when the BHA includes a stabilized underreamer (i.e. a expandable bit). It should be noted that the side load on a fulcrum point (either the motor stabilizer, or the pads of a stabilized underreamer) is generally about 25 to 50% higher than that of the bit.

As such, FIG. 10 indicates that bit side loads are high on steerable motors and stabilized underreamers, and the addition of flexible members can significantly reduce side loads. High side loads can damage stabilized underreamer mechanisms and, in circumstances where flexibility is added to conventional motors and RSS bottom hole assemblies, improved bit life may result. Furthermore, in the case of stabilized underreamers run adjacent to the pilot bit, reduction in side load may be necessary to allow proper functionality of the stabilized underreamer. Nonetheless, the flex systems reduce bit side load as the systems analyzed in FIG. 10 are designed to result in the same 5.5°/100 ft build rate.

Figure 11:
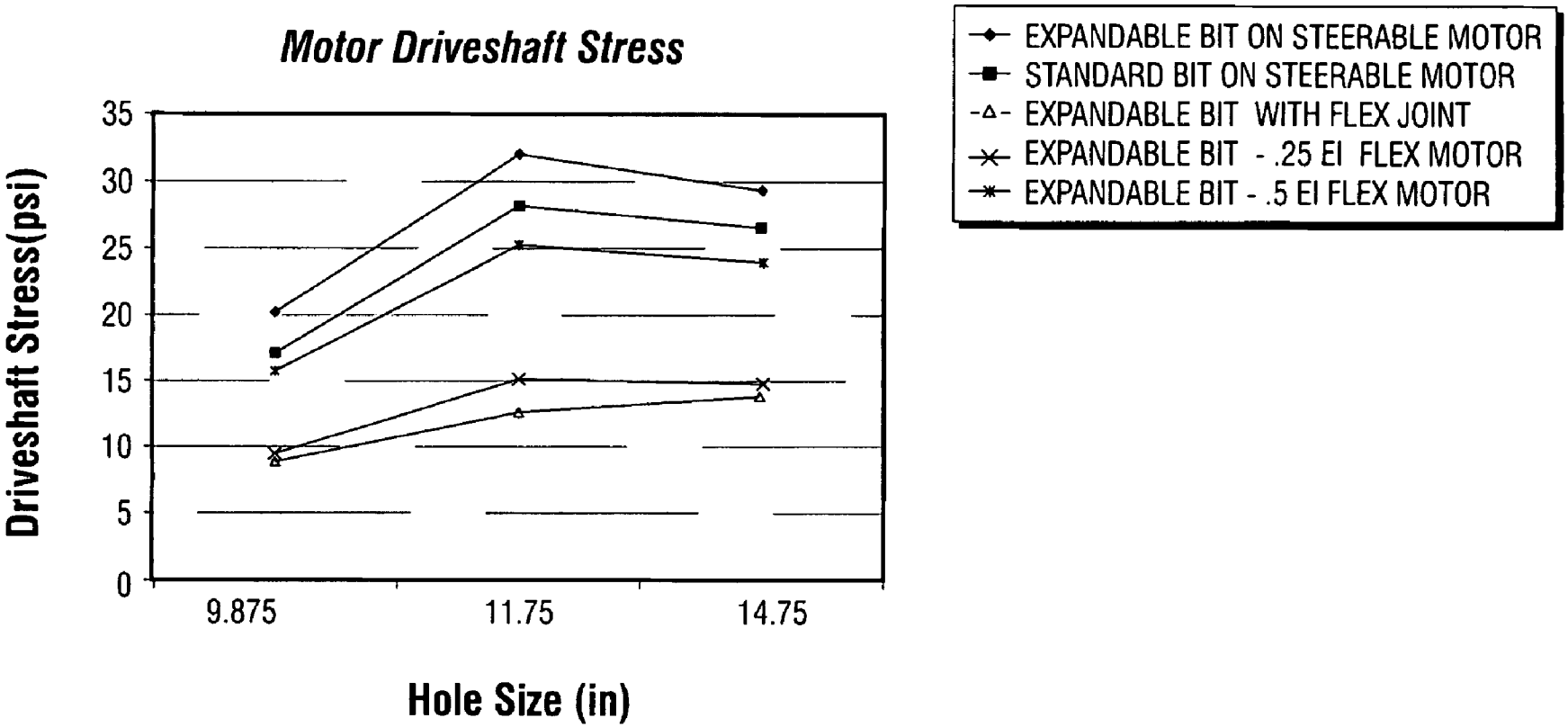
FIG. 11 is a graphical representation of drive shaft stress as a function of hole size for various bottom hole assemblies in accordance with embodiments of the present invention.

Referring now to FIG. 11, the graphical representation depicts stress in the driveshaft for the same five BHA systems of FIG. 10. From the graph, it is worthy of note that stabilized underreamer (i.e. expandable bit) systems experience the highest amount stress when compared to the standard bits, even though FIG. 10 showed bit load to be slightly lower than a conventional directional system. Therefore, it is understood from FIG. 11 that expandable bits and stabilized underreamers may result in high driveshaft stresses if run on conventional directional systems without the benefit of a flex member. As mud motor drive shafts have been known to fail from fatigue stresses, the introduction of flex members in the bottom hole assembly may help reduce those failures without reducing the bend angle.

Figure 12:
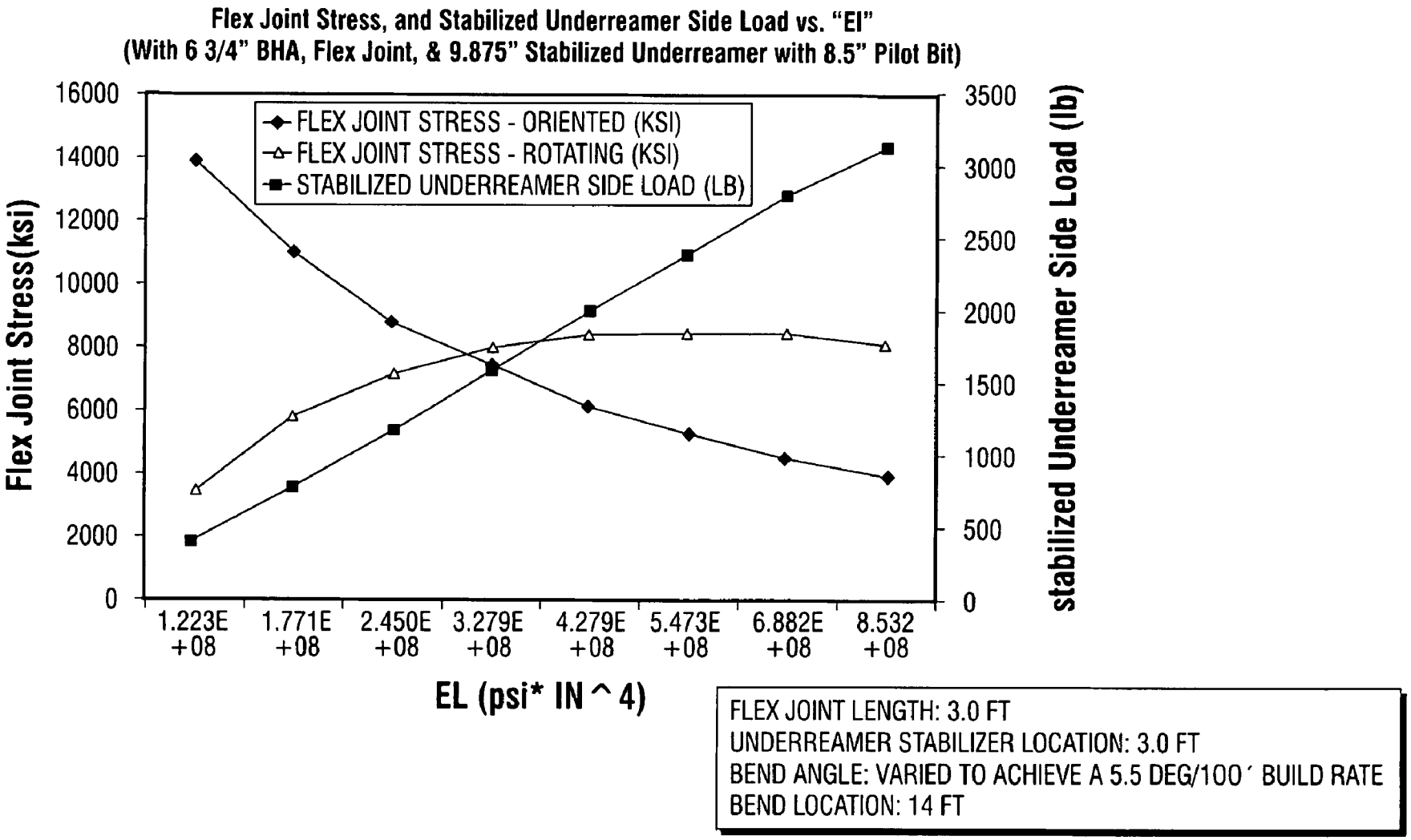
FIG. 12 is a graphical representation of flex member stress and side load as a function of EI for a 6¾" bottom hole assembly in accordance with embodiments of the present invention.
Figure 13:
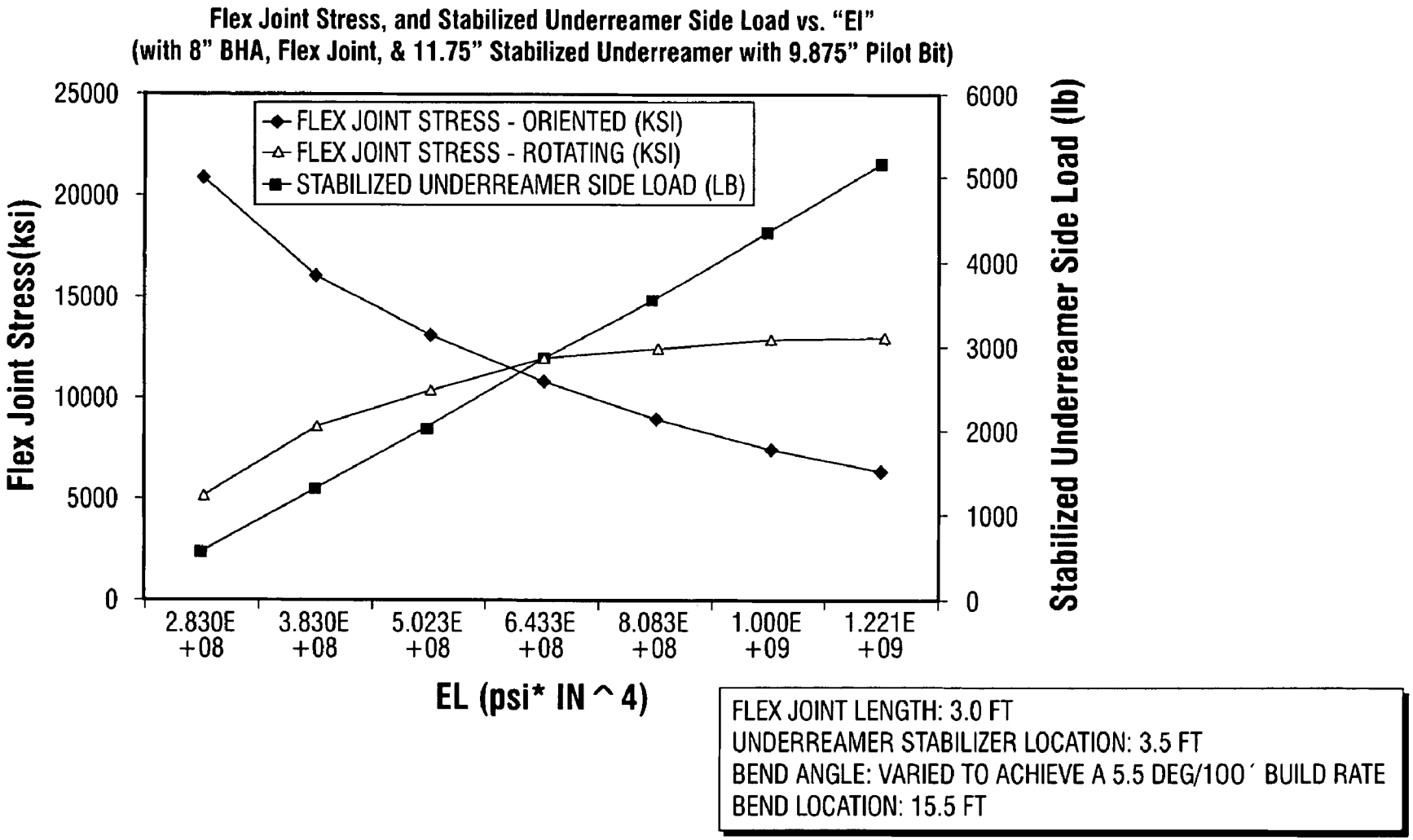
FIG. 13 is a graphical representation of flex member stress and side load as a function of EI for a 8" bottom hole assembly in accordance with embodiments of the present invention.
Figure 14:
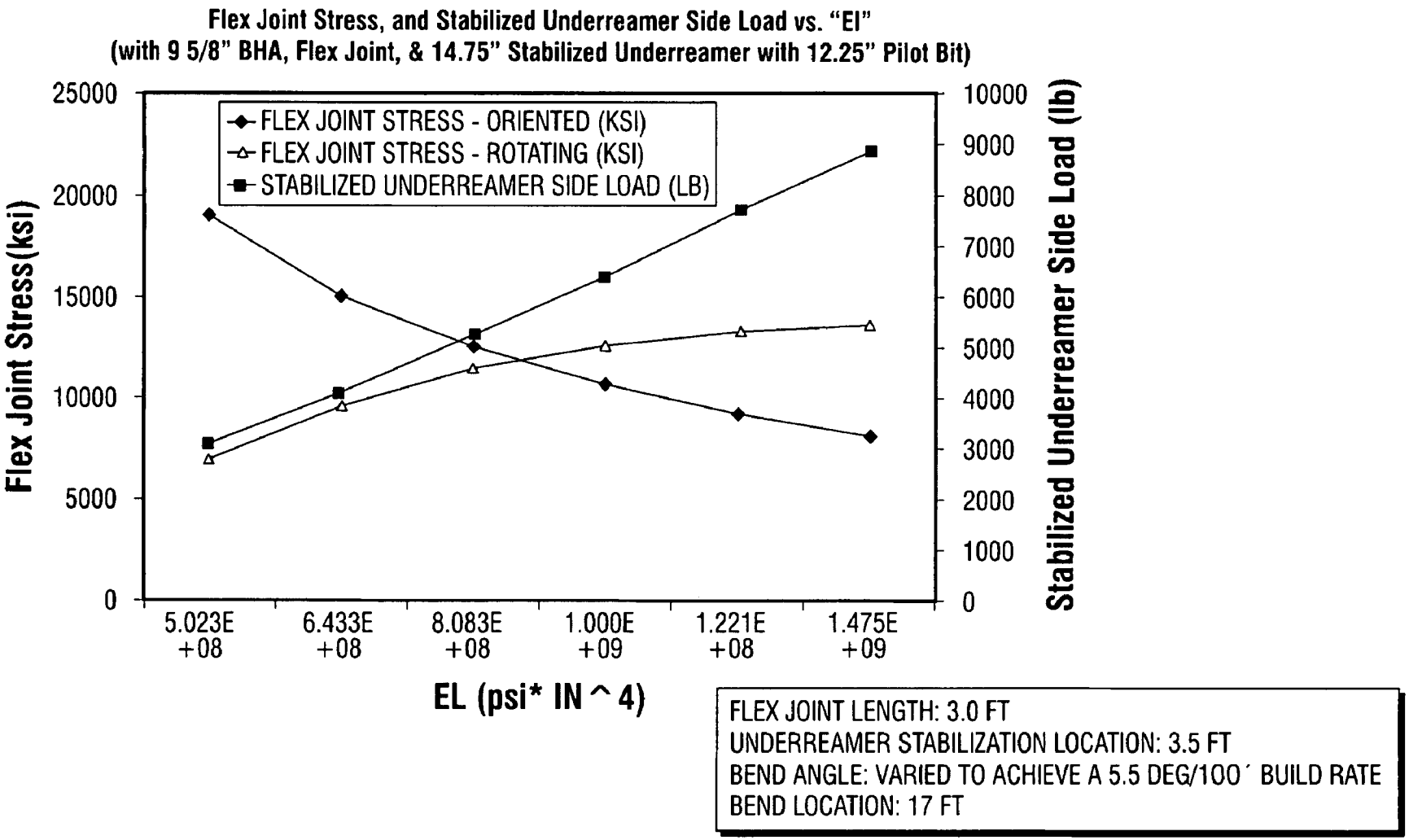
FIG. 14 is a graphical representation of flex member stress and side load as a function of EI for a 9⅝" bottom hole assembly in accordance with embodiments of the present invention.

Referring now to FIGS. 12-14 together, graphical representations of flex member stress in various operating conditions are shown as a function of EI for 6¾" (FIG. 12), 8" (FIG. 13), and 9⅝" (FIG. 14) sized bottom hole assemblies.

Particularly, FIGS. 12-14 depict refer to a standard drive mechanism (e.g. a positive displacement mud motor or a RSS) with a flex member positioned between the drive mechanism and the bit (e.g. as depicted in FIGS. 1 through 6). As described above, the "bit" may be a conventional bit or a combination pilot bit with stabilized underreamer. In FIG. 12, the bit is described as an 8½" pilot bit leading a 9⅞" stabilized underreamer on a 6¾" bottom hole assembly. Similarly, in FIG. 13, the bit is described as a 9⅞" pilot bit with a 11¾ stabilized underreamer on a 8" bottom hole assembly. Finally, FIG. 14 depicts a 12¼" pilot bit with a 14¾" stabilized underreamer on a 9⅝" bottom hole assembly.

In FIGS. 12-14, two lines show flex joint stress as a function of EI. The first line depicts stress while the system is performing an oriented drilling operation. The term "oriented drilling" term is used instead of "sliding" so that it generically includes both sliding of a bent housing and mud motor drilling assembly, as well as the mode of pointing the bend of a RSS assembly in one direction while rotating the drill string. The second line represents flex member stress while in a rotating operation. For a bent housing and mud motor arrangement, this means that the bent housing is rotating and is not constantly pointed in one direction. For an RSS arrangement, this similarly indicates that the bend or articulation is not constantly pointed in one direction.

From FIGS. 12-14, it should be noted that flex joint may buckle to some extent when axial load (i.e. weight-on-bit) is applied. Thus, the "oriented" curve depicts that in an oriented drilling operation, the more flexible the flex joint is constructed, the more it may buckle and become highly stressed. In contrast, the "rotating" curve depicts that under rotation, stiffer the flex joint constructions yield elevated stresses. As it is typical for a BHA to be used to drill in both oriented and rotating modes, a value for flex joint stiffness EI that exhibits acceptable stress levels in both modes is preferred. Therefore, one of ordinary skill in the art would expect that an optimal stiffness may be found in the range near where the two oriented and rotating mode curves intersect.

Finally, the last curve on the graphs of FIGS. 12-14 represents the side load experienced by a stabilized underreamer. As one goal of the use of a flex member in the BHA is to reduce side load in expandable bit-type assemblies, the maximum side load for a particular stabilized underreamer will be useful in determining an upper limit for the flexibility (i.e., the EI) of the flex member. At loads in excess of the maximum side load, the stabilized underreamer runs the risk of either, not opening completely, not operating properly, or both. As such, the side load curve can be used in conjunction with the flex joint stress curves by a BHA designer to determine an appropriate size and material for the BHA's flex member.

Figure 15:
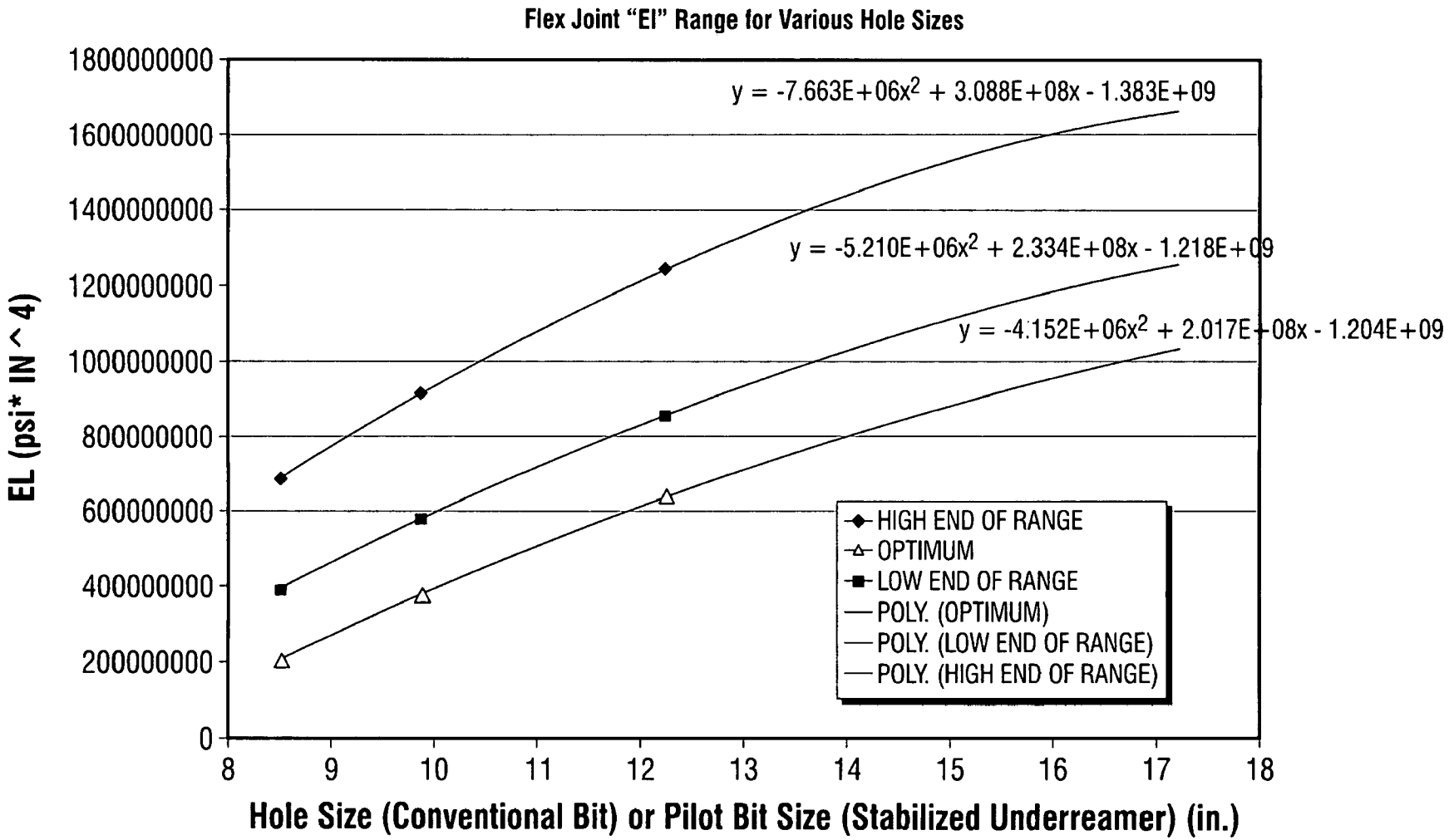
FIG. 15 is a graphical representation of an EI range as a function of hole size for various bottom hole assemblies in accordance with embodiments of the present invention.

Referring now to FIG. 15, a graphical representation of a range of EI values for flex members used in combination with various bit sizes is shown. As with FIGS. 12-14, FIG. 15 refers to a standard drive mechanism (e.g. a positive displacement mud motor or a RSS) with a flex member positioned between the drive mechanism and the bit (e.g. as depicted in FIGS. 1 through 6). In FIG. 15, data from FIGS. 12-14 is used to generate three curves that define the maximum, optimum, and minimum EI for a range of hole sizes. Next, a curve is fit to those ranges such that an algebraic expression is derived. For the purposes of simplicity, the term "bit size" as used in relation to FIG. 15 refers to either the diameter of a conventional bit or the diameter of a pilot bit used in conjunction with a stabilized underreamer. In the case of the latter, "bit size" does not refer to the final underreamed diameter of the borehole.

Figure 16:
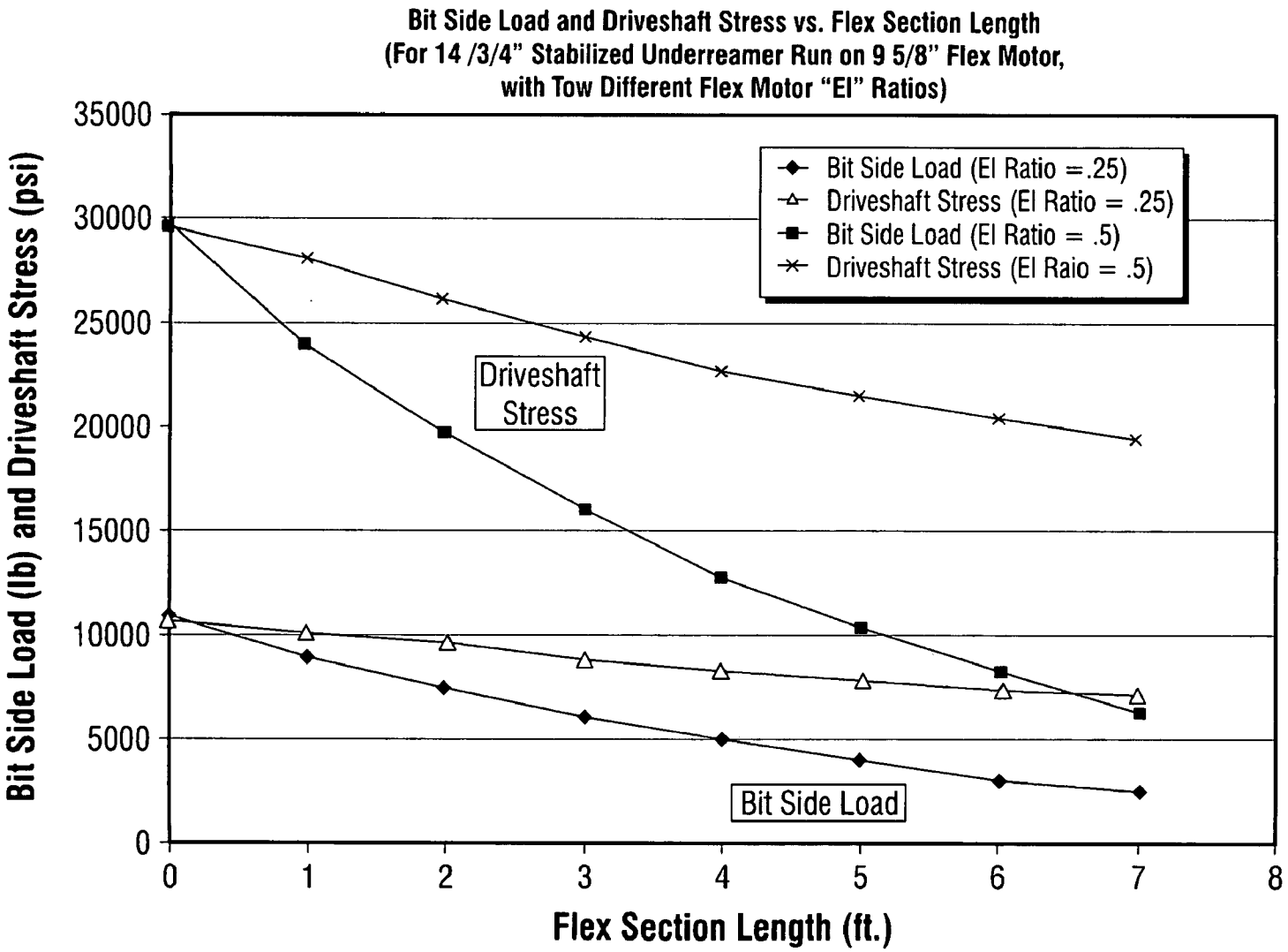
FIG. 16 is a graphical representation of bit side load and driveshaft stress as a function of flex member length for a bottom hole assembly in accordance with embodiments of the present invention.

Referring finally to FIG. 16, a graphical representation of bit side load and drive shaft stress as a function of flex member length for various EI values is shown. FIG. 16 refers to a BHA with a flex member integrated into a drilling assembly housing, as depicted in FIGS. 7-9. In the Figure, a pair of lines represent drive shaft stress and bit side load for a flex member having an EI ratio of 0.25 and a second pair of lines represent drive shaft stress and bit side load for a flex member having an EI ration of 0.50. As such, the graph of FIG. 16 discloses that as the length of the flex member is increased, stresses in the motor drive shaft and side loads in the bit are reduced. However, because it is advantageous to have certain BHA components (e.g. measurement tools, stabilizers, etc.) as close to the bit as possible, the graph of FIG. 16 may be used by a BHA designer to pick a flex member that is only long enough to reduce the bit side loads and drive shaft stresses to a predetermined maximum. Any further increases in flex member length might negatively impact the effectiveness of remaining BHA components at the expense of excessively reduced stresses and bit loads.

While certain geometries and materials for flex members in accordance with embodiments of the present invention are shown, those having ordinary skill in the art will recognize that other geometries and/or materials may be used. Furthermore, as stated above, selected embodiments of the present invention allow a bottom hole assembly to be constructed and used to enable directional drilling at enhanced build rates. Furthermore, flex members in accordance with embodiments of the present invention allow the trajectory of a bottom hole assembly to be deviated without impacting severe bending and side loads upon load-sensitive drilling assembly components. Particularly, premature wear within output shafts and bearings of positive displacement mud motors and articulating sleeves of point-the-bit RSS assemblies can be reduced, translating into more profitable drilling for the drilling operator. Furthermore, while certain embodiments of the present invention include flex members capable of being retrofitted with existing BHA components, other embodiments disclose such assemblies having integral flex members. While embodiments featuring universal flex members allow aspects of the present invention to be applied to preexisting equipment with little capital investment, embodiments featuring the integral flex members enable the development of more efficient and optimized drilling systems for the future.

While preferred embodiments of this invention have been shown and described, modifications thereof may be made by one skilled in the art without departing from the spirit or teaching of this invention. The embodiments descried herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed:

1. A bottom hole assembly to directionally drill a subterranean formation, the bottom hole assembly comprising:

a drill bit;

a stabilized underreamer component located proximate to and behind the drill bit, wherein the stabilized underreamer component comprises a stabilizer pad and at least one reamer cutter;

a drilling assembly comprising a drive mechanism and a directional mechanism; and a flex member located between the drilling assembly and the stabilized underreamer component, wherein the flex member comprises:

a reduced moment of inertia portion extending between the stabilized drill bit and an output shaft of the directional drilling assembly;

a transition region located between the reduced moment of inertia portion and the stabilized drill bit; and wherein the reduced moment of inertia portion is configured to be locally flexible along a length thereof relative to components of the directional drilling assembly.

2. The bottom hole assembly of claim 1, wherein the drive mechanism comprises at least one selected from the group consisting of a drillstring, a positive displacement mud motor, and a turbine motor.

3. The bottom hole assembly of claim 1, wherein the directional mechanism comprises at least one selected from the group consisting of a rotary steerable device and a bent housing.

4. The bottom hole assembly of claim 1, wherein the stabilized underreamer component is integral with the drill bit.

5. The bottom hole assembly of claim 1, wherein the stabilizer pad of the stabilized underreamer component is located behind the drill bit by a distance of between one to five times a cutting diameter of the drill bit.

6. The bottom hole assembly of claim 1, wherein the stabilizer pad of the stabilized underreamer component is located behind the drill bit by a distance of one to two and a half times a cutting diameter of the drill bit.

7. The bottom hole assembly of claim 1, wherein the flex member is integral to an output shaft of the drive mechanism.

8. The bottom hole assembly of claim 1, wherein the flex member comprises an outer diameter smaller than an outer diameter of the drive mechanism.

9. The bottom hole assembly of claim 1, further comprising a second stabilizer component located uphole from the directional mechanism of the drilling assembly.

10. The bottom hole assembly of claim 1, further comprising a second transition region located between the reduced moment of inertia portion and the output shaft of the directional drilling assembly.

11. The bottom hole assembly of claim 1, wherein the reduced moment of inertia portion is integral to the output shaft of the directional drilling assembly.

12. The bottom hole assembly of claim 1, wherein the reduced moment of inertia portion is constructed from a material having a modulus of elasticity that is lower than a modulus of elasticity of the output shaft of the directional drilling assembly.

13. The bottom hole assembly of claim 1, wherein the reduced moment of inertia portion is constructed from a material selected from a group consisting of copper-beryllium, copper-nickel, steel, and titanium.

14. A bottom hole assembly to directionally drill a subterranean formation, the bottom hole assembly comprising:

a drill bit;

a stabilized underreamer component located behind the drill bit, wherein the stabilized underreamer component comprises a stabilizer pad and at least one reamer cutter;

a drilling assembly comprising a drive mechanism and a directional mechanism; and a flex member located within a housing of the drilling assembly, wherein the product of a modulus of elasticity and a moment of inertia for a cross-sectional portion of the flex member is between about 20% and about 60% of the EI of remaining components of the housing of the drilling assembly.

15. A bottom hole assembly to directionally drill a subterranean formation, the bottom hole assembly comprising:

a drill bit;

a stabilized underreamer component located proximate to and behind the drill bit, wherein the stabilized underreamer component comprises a stabilizer pad and at least one reamer cutter;

a drilling assembly comprising a drive mechanism and a directional mechanism; and a flex member located between the drilling assembly and the stabilized underreamer component, wherein the product of a modulus of elasticity and a moment of inertia for a cross-sectional portion of the flex member is between about 20% and about 60% of the EI of an adjacent component of the bottom hole assembly.

* * * * *